United States Patent [19]

Decker et al.

[11] 3,980,169

[45] Sept. 14, 1976

[54] IMPACT CONTROL FOR SINGLE ELEMENT PRINTER

[75] Inventors: Herbert Decker, Lauf; Gerald Nowak, Bienrode, both of Germany

[73] Assignee: Triumph Werke Nurnberg A.G., Nurnberg, Germany

[22] Filed: Feb. 26, 1975

[21] Appl. No.: 553,166

Related U.S. Application Data

[63] Continuation of Ser. No. 455,280, March 27, 1974, abandoned, which is a continuation of Ser. No. 288,652, Sept. 13, 1972, abandoned.

[30] Foreign Application Priority Data

Oct. 1, 1971 Germany ..... 2149094

[52] U.S. Cl. ..... 197/55; 197/17

[51] Int. Cl.[2] ..... B41J 1/32

[58] Field of Search ..... 197/16, 17, 18, 52, 197/55, 48

[56] References Cited

UNITED STATES PATENTS

| | | | |
|---|---|---|---|
| 1,652,463 | 12/1927 | Tyberg | 197/16 |
| 2,750,022 | 6/1956 | Long | 197/17 |
| 2,796,966 | 6/1957 | Toeppen | 197/17 |
| 3,239,049 | 3/1966 | Voit | 197/17 X |
| 3,330,398 | 7/1967 | Hylan | 197/55 |
| 3,393,787 | 7/1968 | Dodge et al. | 197/17 |
| 3,451,520 | 6/1969 | Greer et al. | 197/16 X |
| 3,618,736 | 11/1971 | Abell et al. | 197/17 |

*Primary Examiner*—Ralph T. Rader
*Attorney, Agent, or Firm*—Joseph R. Spalla

[57] ABSTRACT

A single element type carrier having type characters with different printing areas is impacted against a recording medium with different impact intensities substantially corresponding to the different printing areas to effect uniform printing. The type carrier is driven in a printing movement by a resiliently biased member which imparts an impacting force to the type carrier as the member moves along a path in response to the rotational movement of a cam. To control the impacting force imparted to the type carrier, one of a plurality of stop abutments is selectively positionable in the path of the resiliently biased member to control the length of movement along the path during which the member imparts an impacting force to the type carrier.

5 Claims, 4 Drawing Figures

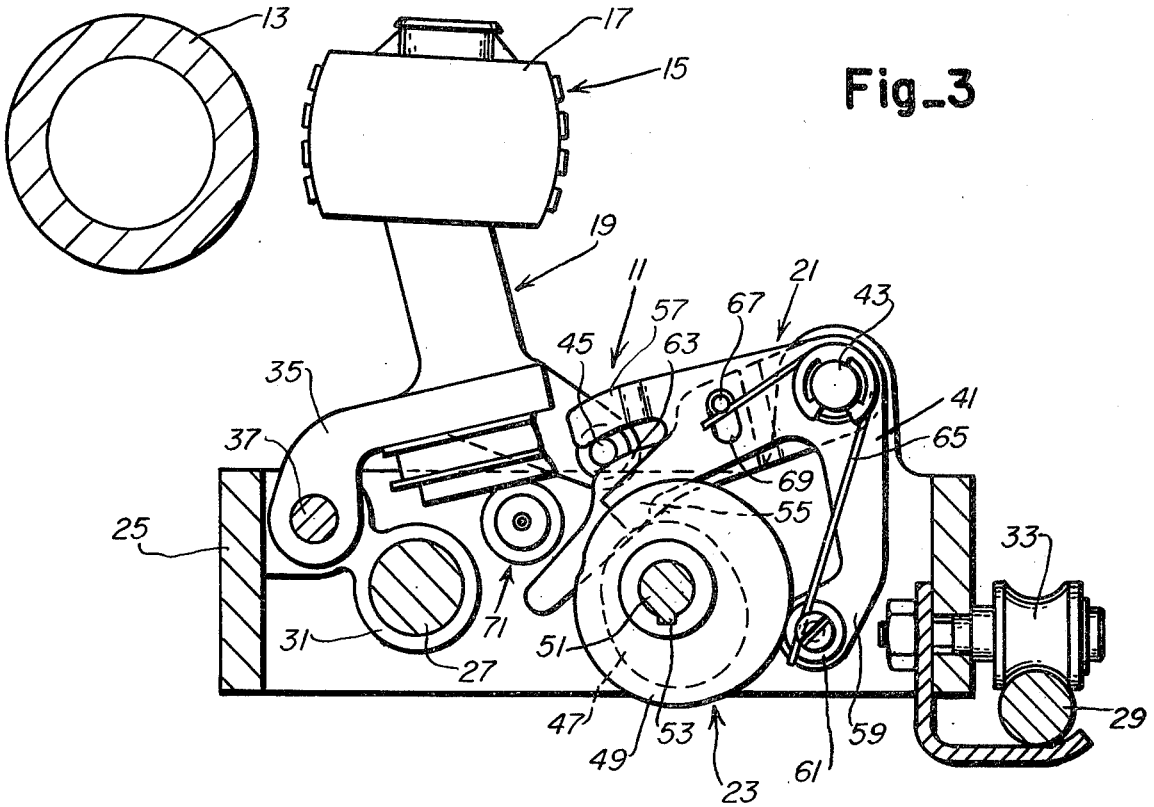
Fig_3
Fig_4
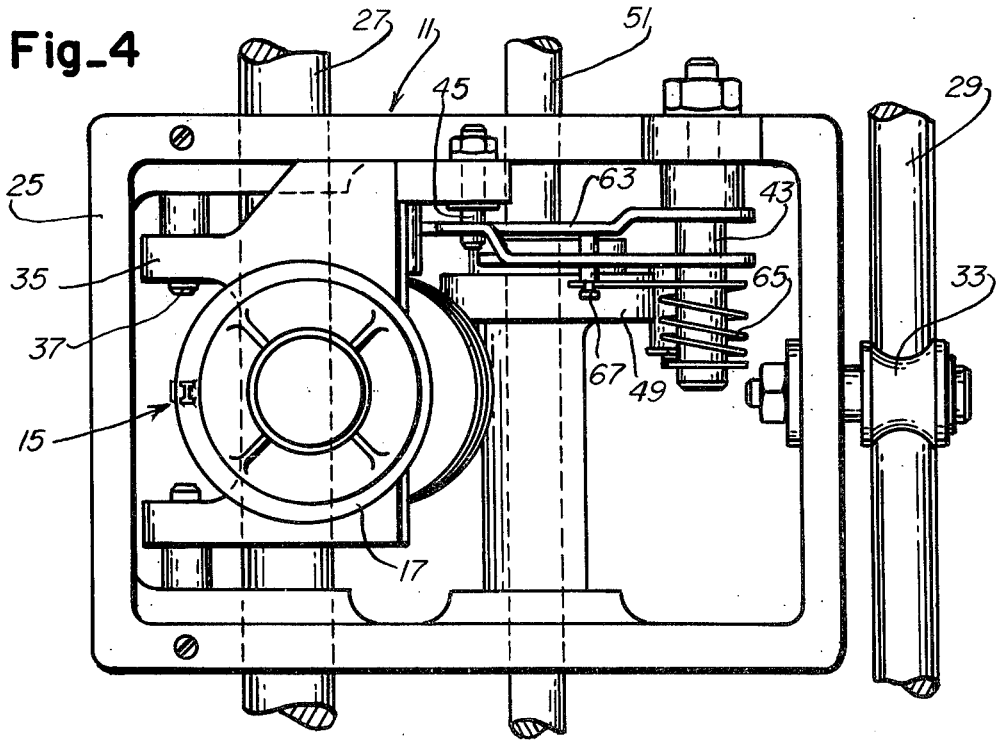

IMPACT CONTROL FOR SINGLE ELEMENT PRINTER

This is a continuation of application Ser. No. 455,280, filed Mar. 27, 1974 now abandoned, which is a continuation of application Ser. No. 288,652, filed Sept. 13, 1972, also now abandoned.

This invention relates to an impact control for a single element printer, and more particularly to an arrangement for effecting uniform printing of type characters having different printing areas by enabling different impacting forces to be imparted to a single element type carrier as different type characters are printed.

In a single element typewriter, a plurality of different type characters are carried on a single element type carrier, and printing is effected by the type carrier undergoing a common printing stroke to impact a selected type character against a recording medium. However, the type characters typically have different printing areas, and to produce uniform printing the type characters must be impacted against the recording medium with different impact intensities in accordance with the printing area of each particular type character.

In the past, different arrangements have been provided to vary the impacting force imparted to the type carrier so as to achieve substantially uniform printing. For example, in German Pat. No. 1,190,006, the single element type carrier was selectively driven in a printing movement by one of a plurality of different rotatable camming plates each imparting a different impacting force thereto. In this arrangement, a cam follower was selectively movable into engagement with one of the different camming plates, and type characters having substantially the same printing area were grouped together on the type carrier for printing in association with the same cam. However, such an arrangement is undesirable because it is complicated, expensive to construct and requires too much space. Accordingly, an object of the present invention is to provide an inexpensive arrangement for selectively controlling the impacting force imparted to a single element type carrier so as to achieve uniform printing of type characters having different printing areas.

Another object of the invention is to provide an arrangement for controlling the impacting force imparted to a single element type carrier and which requires a minimum amount of space.

Still other objects, features and advantages of the present invention will become apparent to those skilled in the art from a reading of the following detailed description of the invention, taken in conjunction with the accompanying drawing, wherein:

FIG. 3 is a side view of the single element printer shown in FIG. 1; and

FIG. 4 is a partial top view of the single element printer shown in FIG. 1.

Figure 1:
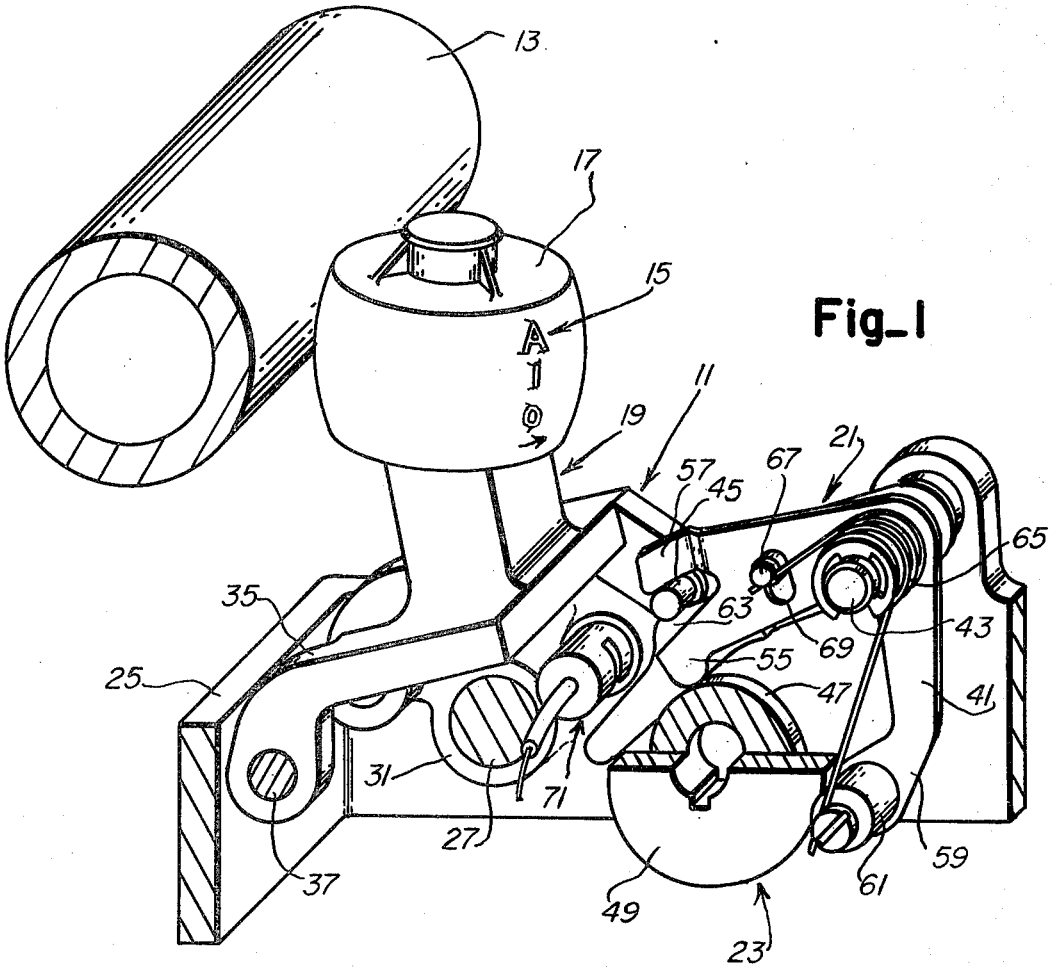
FIG. 1 is a partial perspective view of a single element printer constructed in accordance with the present invention.

Referring now in detail to the figures in the drawing, there is shown in FIG. 1 a typewriter printing arrangement, generally indicated 11, for printing type characters on a recording medium (not shown) which medium may desirably be held against a platen 13. The type characters to be printed are generally indicated by reference numeral 15 and are formed on a generally spherical element 17 of a type carrier, generally indicated by reference numeral 19. The type carrier 19 is supported for a printing movement from a rest position to a printing position at the platen 13, and printing is effected by impacting a selected type character against the recording medium. The type carrier 19 is driven in a printing movement by moving means, generally indicated 21, which are operated by a drive means, generally indicated 23, which may desirably be powered by a motor, not shown. The printing arrangement 11 is supported on a carriage 25 for movement along a line of type past the platen 13, and the carriage is mounted on two parallel shafts 27, 29 for movement past the platen 13. The shaft 27 is suitably received in a bore 31 formed in the carriage 25, and a roller 33 which is suitably secured to the carriage 25, rests on the shaft 29. The recording medium, the motor for powering the drive means 23 as well as other portions of the typewriter printing arrangement are not shown since they form no part of the present invention and may be desirably conventional.

As shown, the type carrier 19 has a rocker or base element 35 which is supported for pivotal movement by pins 37 or other conventional means which may be suitably secured to the carriage 25. The moving means 21 for moving the type head 19 to and from the printing position includes a cam follower 41 which is pivotally supported about a shaft 43 on the carriage 25 and acts on a stud 45 projecting from the type carrier 19. The drive means 23 for operating the moving means 21 includes camming means in the form of two camming plates 47, 49 which are carried side-by-side on a shaft 51 and secured for rotation therewith by means of a suitable key 53. As shown, the camming plates 47, 49 may desirably be formed integrally with each other. The shaft 51 undergoes a revolution each time a type character 15 is printed, and the type head 19 is driven to the printing position by means responsive to the clockwise movement of the cam follower 41 through engagement of its arm 55 with the cam plate 47. After printing, the type head 19 is returned to the rest position by counterclockwise movement of the cam follower 41 through engagement of its arm 59 and associated roller 61 with cam plate 49 and its arm 57 acting on the stud 45.

Since the type carrier 19 is moved to and from the printing position by the cam follower 41 in response to the rotational movement of the cam plate 47, and since the configuration of the cam plate 47 is fixed, it is apparent that the rotational movement of the camming plate 47 will provide the same impacting force to the type carrier 19 irrespective of the printing area of the particular type character to be printed and will result in non-uniform printing. In accordance with the present invention, the impacting force imparted to the type carrier 19 may be selectively varied as required by the type character selected for printing. This is accomplished by constructing the moving means to act on the type carrier along variable distances and by providing means for selectively limiting the distance or time interval over which the moving means 21 acts on the type carrier 19.

As shown, the moving means 21 includes a member 63 which is pivotally supported about the shaft 43 and acts on the stud 45 to move the type carrier 19 in response to the movement of the cam follower 41. The member 63 is resiliently biased relative to the cam follower 41 by means of a motion transmitting spring 65 rotatably mounted on shaft 43 so as to press the stud 45 against the arm 57 of the cam follower 41. As shown, the spring 65 is wrapped around the shaft 43 with one end of the spring 65 suitably secured to the arm 59 of the cam follower 41, while the other end of the spring 65 is secured to a post 67 which extends through an opening 69 in the cam follower 41 and is attached to the member 63. The member 63 urged between follower driven spring 65 undergoes a clockwise pivotal movement along a predetermined path in response to the rotational movement of the cam plate 47 and acts on stud 45 to drive the type carrier 19 to print. To control the impacting force imparted to the type carrier 19 by the movement of the member 63, limit means, generally indicated 71, are positioned in the path of the member 63 for selectively controlling the distance along the path that the member 63 acts on the type carrier 19.

Figure 2:
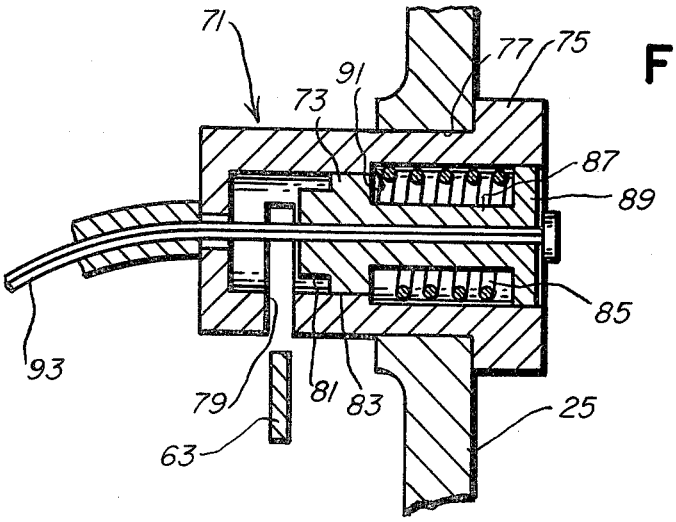
FIG. 2 is an enlarged sectional view of the means used to limit the driving interval and thus the force imparted to the type carrier during a printing movement.

As more particularly shown in FIG. 2, the limit means 71 includes a cylindrical member 73 which is slidably disposed in a bushing 75. The bushing 75 is suitable secured in an opening 77 of the carriage 25 and has a slot 79 formed therein for receiving a portion of the member 63. The cylindrical member has a reduced end-portion 81 serving to define a stop abutment for engagement by the member 63 while the outer diameter piston serves as another stop abutment 83 for the member 63. Although only two stop abutments are shown, it is to be understood that the cylindrical member 73 may have several reduced portions forming additional stop abutments as desired.

In operation, when a type character having a relatively large printing area, for example a capital M or W is to be printed, it is desirable to impart the full impacting force to the type carrier 19. Accordingly, in response to the rotational movement of the cam 47, the follower 41 will be driven clockwise about shaft 43 and, as its arm 59 is connected to one end of spring 65 connected to stud 67 on member 63, will drive the member 63 along the full length of its path to impart a maximum impacting force to the type carrier 19. During this movement, the resiliently biased member 63 will maintain the stud 45 pressed against the follower arm 57, and a portion of the member 63 will move into the slot of the limit means 71. The cylindrical member 73 is normally urged away from the slot 79 by resilient biasing means 85, and accordingly the member 63 normally moves freely in the slot 79. As shown, the resilient biasing means 85 is in the form of a spring coiled around a reduced intermediate portion 87 of the cylindrical member 73 which forms an annular shoulder 89 engaged by one end of coiled spring 85 while the other end engages an annular abutment 91 formed in the bushing 75.

When a type character 15 having a smaller printing area is to be printed, the cylindrical member 73 is moved slidably in the bushing 75 against the urging of the spring 85 to position one of the stop abutments 81, 83 in the slot 79 to block the movement of the member 63 along the predetermined path. The cylindrical member 73 is moved in response to the actuation of a suitable key mechanism, not shown, by a pulling force exerted on a cable 93 which is suitably secured to the cylindrical member 73. Accordingly, an impacting force will be imparted to the type carrier 19 by the member 63 acting on the stud 45 in response to the rotational movement of the cam 47 until the member 63 engages one of the stop abutments 81, 83 in the slot 79, thereby limiting the movement of the member 63 along the predetermined path, short of a full stroke, terminating powered drive to the type carrier 19 which continues to printing movement by reason of its momentum. Continued clockwise rotational driving movement will, since movement of member 63 is arrested, cause the spring 65 to give, with the slot 69 and cam follower arm 55 permitting relative movement between the cam follower 41 and the arrested member 63 until the type carrier 19 impacts at the printing position, at which time cam follower 41 will be driven counterclockwise by arm 59 with its arm 57 acting on the stud 45 to return the type carrier 19 to the rest position and allowing member 63 to reengage the stud 45.

We claim:

1. Impression control mechanism for a single element printer comprising a platen, a single element type carrier having large and smaller area type characters located thereon, means supporting said type carrier for pivotal movement from a rest position toward said platen for impacting a selected type character thereagainst, said type carrier support means including a drive abutment, a rotatable cam, pivotally mounted cam follower means associated with said cam, a pivotally mounted drive member engaging said drive abutment, said drive member adapted when driven to drive said type carrier support means toward said platen, spring means connected between said cam follower means and said drive member for transmitting driving motion of said cam to said drive member over a full cam stroke when large area type characters are selected for printing, and means selectively interposable in the path of motion of said driven drive member to arrest its movement in advance of a full cam stroke when smaller area type characters are selected for printing to earlier terminate its engagement with said type carrier support means thereby controlling the impact force of a selected smaller area type character against said platen.

2. Impression control mechanism as recited in claim 1, said means selectively interposable in the path of motion of said drive member comprising a plurality of stop abutments corresponding to type characters of different printing area on said type carrier, resilient means normally holding said stop abutments out of the path of said drive member, and means for moving a selected one of said stop abutments in the path of said drive member.

3. Impression control mechanism for a single element printer comprising a platen, a single element type carrier having large and smaller area type characters located thereon, means supporting said type carrier for pivotal movement from a rest position toward said platen for impacting a selected type character thereagainst, said type carrier support means including a drive abutment, a rotatable cam, a pivotally mounted drive member engaging said drive abutment and adapted when driven to drive said type carrier support means toward said platen, pivotally mounted resilient cam follower means for transmitting driving motion of said cam to said drive member over a full cam stroke when large area type characters are selected for printing, and means selectively interposable in the path of motion of said driven drive member to arrest its movement in advance of a full cam stroke when smaller area type characters are selected for printing to earlier terminate its engagement with said type carrier support means thereby controlling the impact force of a selected smaller area type character against said platen, said rotatable cam having a first surface for driving said type carrier support means from rest position and a second surface for returning said type carrier support means to rest position incident to each cycle of rotation, said resilient cam follower means including a multi-armed follower having a first arm engaging said first cam surface, a second arm engaging said second cam surface, said cam follower executing an oscillatory movement in response to each rotation of said cam, and a rotatably supported coil spring having legs extending from opposite ends of said coil, one of said legs being connected to said second arm of said follower and the other to said drive member.

4. Impression control mechanism as recited in claim 3, said cam follower means having a third arm engaging said type carrier support abutment to return said type carrier support means after printing a selected character.

5. Impression control mechanism as recited in claim 3, said follower, said drive member and said spring coil being pivoted on a common shaft.

* * * * *